United States Patent [19]

Rudick

[11] Patent Number: 4,808,349

[45] Date of Patent: Feb. 28, 1989

[54] NON-VENTING, SPRING ASSISTED MICROGRAVITY CARBONATOR AND METHOD OF OPERATION

[75] Inventor: Arthur G. Rudick, Marietta, Ga.

[73] Assignee: The Coca-Cola Company, Atlanta, Ga.

[21] Appl. No.: 155,607

[22] Filed: Feb. 12, 1988

[51] Int. Cl.[4] ..... B01F 3/04

[52] U.S. Cl. ..... 261/82; 99/323.1; 222/373; 261/DIG. 7; 426/477

[58] Field of Search ..... 261/27, 37, 82, 35, 261/DIG. 7; 426/477, 474; 99/275, 323.1, 277.2; 417/395; 222/334, 373

[56] References Cited

U.S. PATENT DOCUMENTS

| | | | |
|---|---|---|---|
| 505,090 | 9/1893 | Carse | 417/536 |
| 1,136,004 | 4/1915 | Gross | 261/DIG. 7 |
| 1,842,872 | 1/1932 | Heuser | 261/DIG. 7 |
| 2,503,376 | 4/1950 | Burgess | 137/122 |
| 2,514,361 | 7/1950 | Baker | 261/27 |
| 2,585,172 | 2/1952 | Reynolds | 417/395 X |
| 3,323,783 | 6/1967 | Schwertfeger et al. | 261/35 |
| 3,898,866 | 8/1975 | Keyes et al. | 261/82 X |
| 4,028,441 | 6/1977 | Richards | 261/DIG. 7 |
| 4,096,059 | 6/1978 | Pinkerton | 137/99 X |
| 4,304,736 | 12/1981 | McMillin et al. | 99/323.1 X |
| 4,629,589 | 12/1986 | Gupta et al. | 261/34.1 |
| 4,708,827 | 11/1987 | McMillin | 426/477 X |

*Primary Examiner*—Richard L. Chiesa

*Attorney, Agent, or Firm*—Birch, Stewart, Kolasch, & Birch

[57] ABSTRACT

A carbonator which includes first and second chambers separated by a movable piston may be used on earth or in the microgravity conditions of outer space. The volume of either chamber are correspondingly increased or reduced due to the movement of the piston. The first chamber can receive carbon dioxide gas at a predetermined pressure. A conduit can thereafter be opened between the chambers to permit the carbon dioxide gas to flow to the second chamber. A spring is provided to cause said piston to move so as to reduce the volume of the first chamber and force the carbon dioxide gas into the second chamber after the two chambers are placed in communication. The conduit is then closed and water at a selected pressure is introduced into the second chamber. Due to the various pressures, the water and carbon dioxide gas mix to form carbonated water. An agitator can be used to aid this mixing. Carbonated water is then formed and this water may then be discharged from the carbonator as the movable piston is moved to reduce the volume of the second chamber. This piston is now moved in response to opening of a valve to permit the carbonated water discharge and in response to reintroduction of carbon dioxide gas into the first chamber. The foregoing steps may then be repeated to permit sequential discharges of carbonated water.

16 Claims, 1 Drawing Sheet

NON-VENTING, SPRING ASSISTED MICROGRAVITY CARBONATOR AND METHOD OF OPERATION

BACKGROUND OF THE INVENTION

1. Field of the Invention

The present invention relates to a carbonator and a method for carbonating for use either on earth or in the microgravity conditions of outer space. More specifically, the present invention relates to the mixing of carbon dioxide gas and water to form carbonated water by forcing a specific mass of carbon dioxide gas into a specific volume of water, to achieve a specific level of carbonation. This carbonator and method will further ensure that the carbon dioxide gas remains in the solution in the carbonator even under microgravity conditions.

2. Description of the Background Art

Various carbonators are known in the art. For instance, U.S. Pat. No. 3,323,783 to Schwertfeger et al discloses a gas-liquid contacting device. An embodiment is disclosed in this Schwertfeger et al. patent in which a premxing and main portion chamber are used. However, as the lower chamber has less volume than the upper chamber, a head space will form in the upper chamber of Schwertfeger et al's device and a phase separation will therefore result in the final product. Also, excess gas will exit the carbonator in addition to the carbonated water and the carbonation level is determined in this device by water temperature and carbon dioxide gas pressure, thus, requiring a complicated monitoring arrangement. Further, a relatively complicated piston arrangement is required in the device of Schwertfeger et al.

Other known arrangements for carbonating water include U.S. Pat. No. 4,629,589 to Gupta et al, entitled "Beverage Dispensing System Suitable for Use In Outer Space", assigned to the same assignee as the present invention. This patent deals with an arrangement for carbonating water in the microgravity conditions of outer space.

A need in the art exists for additional carbonators and methods for carbonating water in the microgravity conditions of outer space, as well as on earth. Such an arrangement must ensure that only carbonated water, and not burst of carbon dioxide gas, are dispensed in the absence of gravity. Thus, the development of a head space must be avoided and any such device or method should be relatively easy to operate.

SUMMARY OF THE INVENTION

Accordingly, it is a primary object of the present invention to provide a carbonator and a method for carbonation which will operate in the zero gravity conditions of outer space, as well as on earth.

It is another object of the present invention to provide a carbonator and method for carbonation which avoids dispensing bursts of carbon dioxide gas.

It is a further object of the present invention to provide a carbonator and method for carbonation which drives a fixed amount of carbon dioxide gas into solution to form carbonated water with no free gas remaining.

It is yet another object of the present invention to provide a carbonator and method for carbonation which does not require positively driven pumps for carrying out the carbonation.

It is still another object of the present invention to provide a carbonator and method for carbonation which will not develop a head space during the storage of carbonated water such that no liquid/gas phase separation will occur.

Another object of the present invention is to provide a carbonator and a method for carbonation wherein a fixed amount of carbon dioxide gas is forced into a fixed volume of water resulting in a fixed level of carbonation such that water temperature and carbon dioxide gas pressure does not have to be monitored.

It is a further object of the present invention to provide a carbonator system which is highly reliable and requires limited maintenance.

Yet another object of the present invention is to provide a carbonator and method for carbonation whereby no excess carbon dioxide gas will be vented from the carbonator.

These and other objects of the present invention are fulfilled by providing a carbonator for producing carbonated water comprising, tank means for holding at least carbon dioxide gas and carbonated water, a movable piston separating said tank means into a first and second chamber, said first chamber receiving carbon dioxide gas at a predetermined pressure, means for selectively permitting communication between said first chamber and said second chamber, said means for permitting communication having an opened and closed position, said opened position permitting said carbon dioxide gas in said first chamber to move to said second chamber, said closed position preventing communication between said first and second chamber, means for urging said piston to move so as to reduce volume of said first chamber when said means for permitting communication is opened, movement of said piston forcing said carbon dioxide gas from said first chamber to said second chamber, means for permitting introduction of water at a selected pressure into said second chamber; said means introducing said water into said second chamber after said second chamber has been filled with carbon dioxide gas at a predetermined pressure, said water and said carbon dioxide gas forming carbonated water due to said pressures of said water and said carbon dioxide gas, and means for discharging said carbonated water from said second chamber, said movable piston simultaneously moving with said discharging in order to reduce volume of said second chamber in order that said carbon dioxide gas remains in solution, said first chamber simultaneously receiving carbon dioxide gas as said movable piston is moved to reduce the volume of said second chamber.

The objects of the present invention are also fulfilled by providing a method for carbonating water comprising the steps of providing a carbonator having a movable piston which separates said carbonator into the first and second chamber, supplying carbon dioxide gas to the first chamber, placing said first and second chambers in communication such that pressure within each chamber is equalized, moving said piston to reduce volume of said first chamber, forcing said carbon dioxide gas from said first chamber to said second chamber in response to movement of said piston, terminating communication between said chambers after said second chamber is filled with carbon dioxide gas, said carbon dioxide gas being at a predetermined pressure, introducing water into said second chamber after said terminating, said water being at a selected pressure, mixing said carbon dioxide gas and said water in said second chamber to form carbonated water, said mixing being accomplished due to said pressures of said water and said carbon dioxide gas, discharging said carbonated water from said second chamber, moving said pistons simultaneously with said discharging to reduce volume of second chamber, maintaining undischarged carbonated water in said second chamber in solution due to said moving of said piston to reduce the volume of said second chamber, and refilling said first chamber with carbon dioxide gas simultaneously with said moving of said piston to reduce volume of said second chamber.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
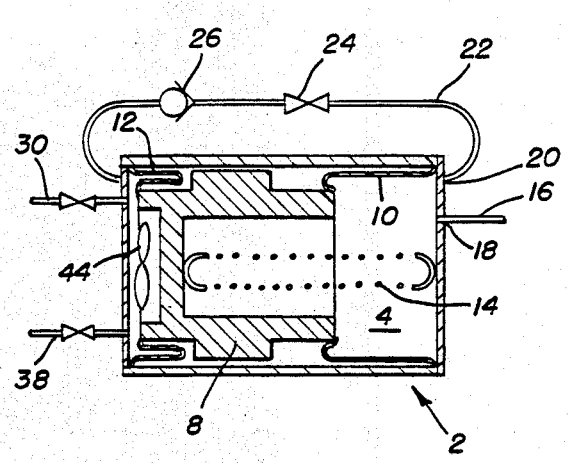
FIG. 1 is a cross-sectional view of the carbonator of the present invention wherein the first chamber is filled with carbon dioxide gas.
Figure 2:
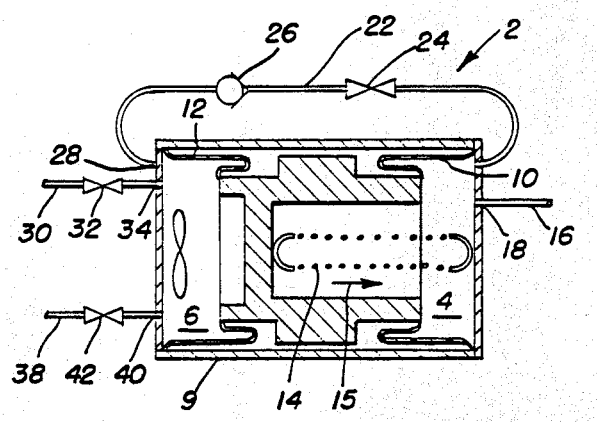
FIG. 2 is a a cross-sectional view of the carbonator of the present invention wherein carbon dioxide gas is moving from the first to the second chamber.

Referring in detail to the drawings and with particular reference to FIG. 1, a non-venting microgravity carbonator 2 is shown. This carbonator consists of a first chamber 4 and a second chamber 6 as indicated in FIG. 2. These two chambers are separated by a movable piston 8. This movable piston 8 is a unitary structure such that a single piston will separate the holding tank 9 into the two chambers 4 and 6.

A first rolling diaphragm 10 is provided on the side of piston 8 having the first chamber 4. A second rolling diaphragm 12 is provided on the other side of the movable piston 8. These rolling diaphragms ensure that an effective low friction seal is maintained between the two chambers 4 and 6.

Within the first chamber 4, a spring 14 is located. This spring 14 extends from the piston to an end wall of chamber 4. This spring is normally in tension such that the piston 8 is urged in the direction indicated by arrow 15 of FIG. 2.

A carbon dioxide gas conduit 16 is provided for first chamber 4. An inlet 18 is provided such that carbon dioxide gas may be introduced into chamber 4. This chamber also has a carbon dioxide gas outlet 20 which leads to a carbon dioxide gas transfer conduit 22. This conduit 22 has a valve 24 for permitting communication between the first chamber 4 and the second chamber 6. A check valve 26 is also provided in this conduit. While this check valve 26 is the only check valve shown, it should be understood that the carbon dioxide gas conduit 16 or the conduits 30 and 38 (which will be discussed below), can also contain check valves. Furthermore, it should be understood that while carbon dioxide gas conduit 16 does not have a valve shown, such a valve may also be incorporated into this conduit.

Figure 3:
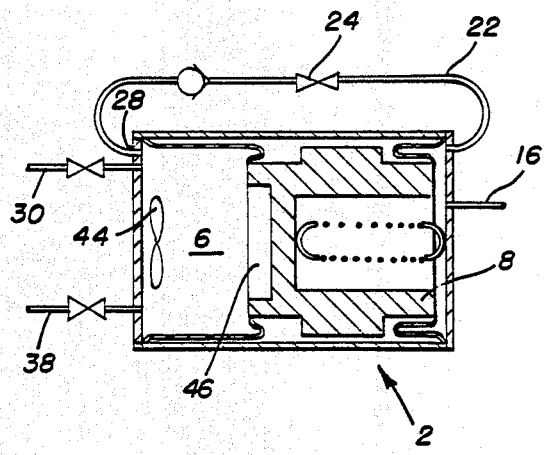
FIG. 3 is cross-sectional view of the carbonator of the present invention wherein the second chamber is filled with carbon dioxide gas.

The carbon dioxide gas transfer conduit 22 leads to a carbon dioxide gas inlet 28 in the second chamber 6 as seen in FIG. 2. This second chamber 6 also has a water conduit 30 having a conduit valve 32 and water inlet 34. Tis second chamber 6 also has a carbonated water outlet 40 which leads to a carbonated water conduit 38 having valve 42. These elements will be discussed hereinbelow. Also, as indicated in FIG. 3, the second chamber 6 has an agitator 44. A recess 46 is provided in the movable piston 8 on the side of this piston facing the second chamber 6. This recess 46 permits the piston 8 to completely enclose the agitator 44 as seen in FIG. 1.

The operation of the device will now be described, first with reference to FIG. 1. Initially, the first chamber 4 is filled with carbon dioxide gas via carbon dioxide gas conduit 16. This arrangement results in the movable piston 8 being located to the extreme lefthand position such that the volume of the second chamber 6 is at a minimum. The volume of the first chamber 4 is at a maximum at this point. Thereafter, the valve 24 in the carbon dioxide gas conduit 22 is opened. Carbon dioxide will be free to exit the first chamber 4 and travel through this conduit 22 to the second chamber 6 as indicated in FIG. 2. The carbon dioxide gas which is in chambers 4 and 6 will be at a pressure of 22 psig.

Spring 14 is provided such that a small spring force sufficient to overcome the friction of the piston will cause the piston to move in the direction indicated by arrow 15. This spring is needed as the pressure in both chamber 4 and 6 are equalized after valve 24 is opened. Without such a spring 14, movement of the piston 8 cannot be achieved. As seen in FIG. 3, the movable piston 8 will travel to an extreme right hand position. In this position, the volume of the first chamber 4 is at a minimum and the volume of the second chamber 6 is at a maximum. It should be noted that the volume of carbon dioxide displaced from the first chamber 4 is equal to the volume of carbon dioxide received by the second chamber 6. Such an arrangement ensures that the proper amount of carbon dioxide is contained in the second chamber 6 when carbonation is carried out. This carbonation will be discussed below.

After the FIG. 3 position for the piston 8 is attained, the valve 24 is closed. Therefore, the first chamber 4 is no longer in communication with the second chamber 6. The second chamber 6 will now contain a fixed volume of carbon dioxide gas at 2.5 atmospheres (absolute).

Figure 4:
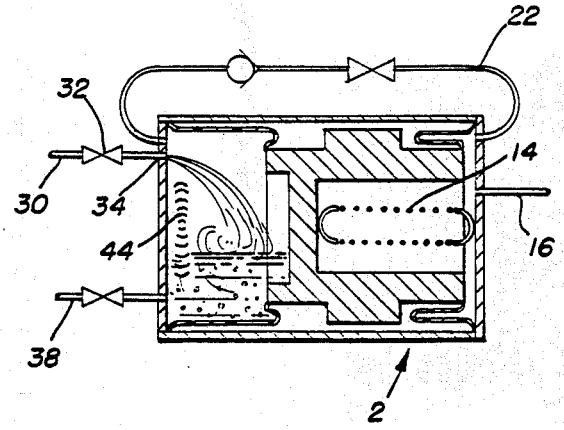
FIG. 4 is a cross-sectional view of the carbonator of the present invention wherein water is being introduced into the second chamber.

As seen in FIG. 4, the agitator 44 will be activated. Simultaneously, valve 32 will be opened in order to permit water to enter chamber 6. This water enters the chamber at 32° F. and at a pressure of 30 psig. Because 30 psig is above the saturation pressure of 2.5 volumes at 32° F., the carbon dioxide gas is forced into solution in the second chamber 6.

Figure 5:
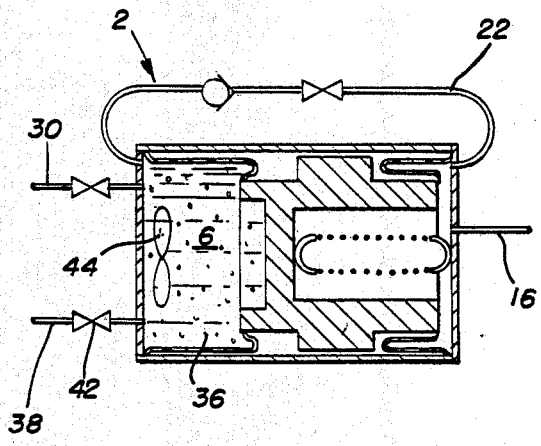
FIG. 5 is a cross-sectional view of the carbonator of the present invention wherein carbonated water is held within the second chamber.

As indicated in FIG. 5, the second chamber 6 will become filled with carbonated water 36. The agitator 44 may be stopped as indicated in FIG. 5. Valve 32 will be closed and the water will be fully carbonated to 2.5 volumes. As set forth above, the carbon dioxide gas which initially entered chamber 4 was at a pressure of 22 psig. It should be noted that different levels of carbonation can be achieved by varying the carbon dioxide gas pressure regulator setting before the carbon dioxide gas enters the first chamber 4 of the carbonator.

As seen in FIG. 5, valve 42 may be opened in order to permit dispensing of the carbonated water. As the carbonated water is dispensed, the movable piston will move in the direction of arrow 48. Thus, the volume of the second chamber 6 is maintained to be equal with the volume of carbonated water contained therein. Such an arrangement avoids the formation of a head space and ensures that the carbon dioxide gas remains in solution. Thus, a steady stream of carbonated water may be dispensed and the creation of burst of carbon dioxide gas during dispensing is avoided.

Figure 6:
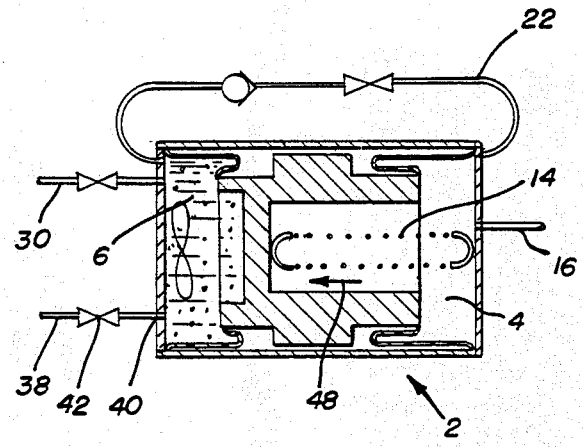
FIG. 6 is cross-sectional view of the carbonator of the present invention wherein carbonated water is being dispensed from the second chamber while the first chamber is being refilled with carbon dioxide gas.

The piston 8 is moved in the direction of arrow 48 as seen in FIG. 6 by the pressure of carbon dioxide gas entering the first chamber 4 through conduit 16. This carbon dioxide gas is at a pressure of 22 psig. and can cause the piston to move in the direction of arrow 48 only when the valve 42 is opened. Valve 42 may remain continuously open to permit total discharge of the carbonated water 36 or it may be sequentially opened and closed to permit discharge of carbonated water as desired.

When the movable piston reaches the left-hand position, such that the second chamber 6 has minimal volume, the FIG. 1 position will again be obtained. Thereafter, the foregoing steps may be repeated such that sequential forming and dispensing of carbonated water may be achieved.

It should be noted that the second chamber 6, which was initially filled with carbon dioxide, is then completely filled with an equal volume of water leaving no additional volume in which a head space due to phase separation can form. This arrangement thus ensures that a head space is not formed in the second chamber 6 and that no phase separation will occur in the final product of carbonated water. This arrangement also ensures that excess gas will not exit the carbonator and further that no excess gas is vented to the atmosphere. As a fixed amount of carbon dioxide gas is forced into a fixed volume of water in the instant invention, a fixed level of carbonation may be achieved. Thus, the use of complicated sensors and monitors as required by the prior art arrangements are not necessary. Also, the movable piston 8 is a unitary structure. Accordingly, this piston is easy to manufacture and requires limited maintenance.

Further, the device of the instant invention is powered by water and carbon dioxide gas pressure, as well as the force of spring 14. This arrangement avoids the use of external motors or pumps and thus simplifies the operation of the device.

Separate metering pumps to measure the carbon dioxide gas fed to the second chamber 6 are also avoided in the instant invention as the maximum volume of the first chamber 4 determines the amount of carbon dioxide gas which will be fed to the second chamber 6. Thus, the metering of the carbon dioxide gas may be accurately and easily carried out.

It should be understood that the carbonator system and method of the instant invention may be utilized in the microgravity conditions of outer space as well as on earth. Also, it is contemplated that a plurality of carbonators may be used such that they may be operated in a predetermined phase whereby continuous dispersing of carbonated water is possible. While this carbonator and method for carbonation have been disclosed as being used for dispensing carbonated water, any other known solutions may be handled by this system. Futhermore, as this invention is contemplated for use in outer space, it should be noted that any recitations to upwardly or downwardly, left hand or right hand contained within the specification have merely been made with reference to the attached drawings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A carbonator for producing carbonated water comprising:

tank means for holding at least carbon dioxide gas and carbonated water;

a movable piston separating said tank means into a first and second chamber, said first chamber receiving carbon dioxide gas at a predetermined pressure;

means for selectively permitting communication between said first chamber and said second chamber, said means for permitting communication having an opened and closed position, said opened position permitting said carbon dioxide gas in said first chamber to move to said second chamber, said closed position preventing communication between said first and second chamber;

means for urging said piston to move so as to reduce volume of said first chamber when said means for permitting communication is opened, movement of said piston forcing said carbon dioxide gas from said first chamber to said second chamber;

conduit means introducing water at a selected pressure into said second chamber, said conduit means introducing said water into said second chamber after said second chamber has been filled with carbon dioxide gas at a predetermined pressure, said water and said carbon dioxide gas forming carbonated water due to said pressures of said water and said carbon dioxide gas; and second conduit means discharging said carbonated water from said second chamber, said movable piston simultaneously moving with said discharging in order to reduce volume of said second chamber in order that said carbon dioxide gas remains in solution, said first chamber simultaneously receiving carbon dioxide gas as said movable piston is moving to reduce the volume of said second chamber.

2. The carbonator as recited in claim 1 further comprising at least one rolling diaphragm which acts with said movable piston to separate said tank means into said first and second chambers and wherein said means for selectively permitting communication comprises a transfer conduit having an openable and closable valve, said transfer conduit extending between said first and second chambers.

3. The carbonator as recited in claim 1 wherein said carbonator is for use in the microgravity conditions of outer space.

4. The carbonator as recited in claim 1, wherein said means for urging comprises a spring arranged to cause said movable piston to move so as to reduce the volume of the first chamber after said means for selectively permitting communication is opened.

5. The carbonator as recited in claim 4, wherein said spring extends from an end wall of said first chamber to said movable piston such that said spring is normally in tension.

6. The carbonator as recited in claim 1 further comprising an agitator located in said second chamber, said agitator being activatable in order to aid formation of said carbonated water.

7. The carbonator as recited in claim 1 wherein said predetermined pressure of said carbon dioxide gas is approximately 22 psig and said selected pressure of said water is approximately 30 psig.

8. The carbonator as recited in claim 1 wherein said first and second chambers each have a maximum volume, said first chamber having a maximum volume after being filled with carbon dioxide gas and before said means for selectively permitting communication is opened, said second chamber having a maximum volume after being filled with carbonated water and before discharging by said means for discharging, said maximum volume of said first chamber being equal to the maximum volume of said second chamber such that the volume of carbon dioxide discharged from the first chamber is equal to the volume of carbon dioxide received by the second chamber, said second chamber lacks additional volume in which a head space due to phase separation can be formed when said second chamber is completely filled with carbonated water.

9. The carbonator as recited in claim 1 wherein a fixed amount of carbon dioxide gas is forced into said second chamber and a fixed volume of water is introduced into said second chamber such that a fixed level of carbonation is attained in said carbonated water.

10. The carbonator as recited in claim 1 wherein said movable piston is a unitary structure and movement of said piston is a result of differences in pressures between the first chamber and the second chamber and a result of said means for urging, said means for urging comprising a spring extending from an end wall of one of said chambers to said movable piston.

11. A method for carbonating water comprising the steps of:

providing a carbonator having a movable piston which separates said carbonator into a first and second chamber;

supplying carbon dioxide gas to the first chamber;

placing said first and second chambers in communication such that pressure within each chamber is equalized;

moving said piston to reduce volume of said first chamber;

forcing said carbon dioxide gas from said first chamber to said second chamber in response to movement of said piston;

terminating communication between said chambers after said first chamber is filled with carbon dioxide gas, said carbon dioxide gas being at a predetermined pressure;

introducing water into said second chamber after said terminating, said water being at a selected pressure;

mixing said carbon dioxide gas and said water in said second chamber to form carbonated water, said mixing being accomplished due to said pressure of said water and said carbon dioxide gas;

discharging said carbonated water from said second chamber;

moving said piston simultaneously with said discharging to reduce volume of said second chamber;

maintaining undischarged carbonated water in said second chamber in solution due to said moving of said piston to reduce the volume of said second chamber; and refilling said first chamber with carbon dioxide gas simultaneously with said moving of said piston to reduce the volume of said second chamber.

12. The method for carbonating as recited in claim 11 wherein the steps are repeatedly carried out to permit sequential discharges of carbonated water.

13. The method for carbonating as recited in claim 11 wherein said moving of said piston to reduce the volume of said first chamber further includes the step of using a spring to facilitate said moving.

14. The method for carbonating as recited in claim 13 further including the steps of:

providing said spring in tension in order to permit automatic movement of said piston after said placing of said first and second chambers in communication; and reducing the tension of said spring as said piston is moved to reduce the volume of said first chamber.

15. The method for carbonating as recited in claim 11 further including the step of using an agitator to aid said mixing of said carbon dioxide gas and said water.

16. The method for carbonating as recited in claim 11 further including the step of using the method in the microgravity conditions of outer space.

* * * * *